United States Patent [19]

Nelson et al.

[11] 4,021,036

[45] May 3, 1977

[54] TENNIS TEACHING MACHINE WITH BALL PROJECTOR

[76] Inventors: David M. Nelson, 939 Rosemary, Deerfield, Ill. 60015; William Stribrsky, 2118 Bristol, Westchester, Ill. 60153; John A. Britz, 189 Oaksbury Lane, Palatine, Ill. 60067

[22] Filed: Dec. 5, 1975

[21] Appl. No.: 637,939

[52] U.S. Cl. ..... 273/29 A; 273/26 R; 35/8 A; 124/51 R; 124/54

[51] Int. Cl.[2] ..... A63B 69/00

[58] Field of Search ..... 273/29 A, 29 R, 26 R, 273/26 A, 187, 30; 124/3, 41, 45, 48, 51 R, 37, 38, 39; 35/29 A, 29 B, 29 C, 29 R, 8 A

[56] References Cited

UNITED STATES PATENTS

| | | | |
|---|---|---|---|
| 2,908,771 | 10/1959 | Gallina | 35/8 A |
| 2,985,069 | 5/1961 | Sampson | 35/8 A |
| 3,222,597 | 12/1965 | Beatenbough | 35/8 A |
| 3,231,271 | 1/1966 | Murphy | 273/29 A |
| 3,677,544 | 7/1972 | Meyers | 273/26 D |
| 3,807,379 | 4/1974 | Vodinh | 273/26 D X |

FOREIGN PATENTS OR APPLICATIONS

| | | | |
|---|---|---|---|
| 613,776 | 5/1935 | Germany | 273/29 R |
| 926,492 | 5/1963 | United Kingdom | 273/26 R |

*Primary Examiner*—Richard C. Pinkham
*Assistant Examiner*—T. Brown
*Attorney, Agent, or Firm*—Hill, Gross, Simpson, Van Santen, Steadman, Chiara & Simpson

[57] ABSTRACT

A tennis teaching machine has a ball hopper slidably mounted on a vertical support. A hollow extension arm protrudes from the ball hopper and has a ball projection mechanism at the end. A rotating ball tray supported within the ball hopper supplies balls to the extension arm and ball projection mechanism. A control unit has a tapedeck which automatically activates the ball projection mechanism when a sensor detects a strip of metal foil on magnetic tape played by a tapedeck. The tennis teaching machine is positioned between two training mats upon which various tennis technique training indicia are inscribed. The student listens to instructions from the control unit and strokes a tennis ball dropped on cue from the extension arm. When stroking the tennis ball, the student positions his feet and racket as indicated by the training indicia on the mats.

7 Claims, 6 Drawing Figures

20
43
22
21
10
23
15
14
19
17
18
8
9
13
11
12

35
30a
20
86
25
72b
33
34
72a
80
23
44
83
82
87
28
21
26
36
42a
81
41
39

Fig. 6
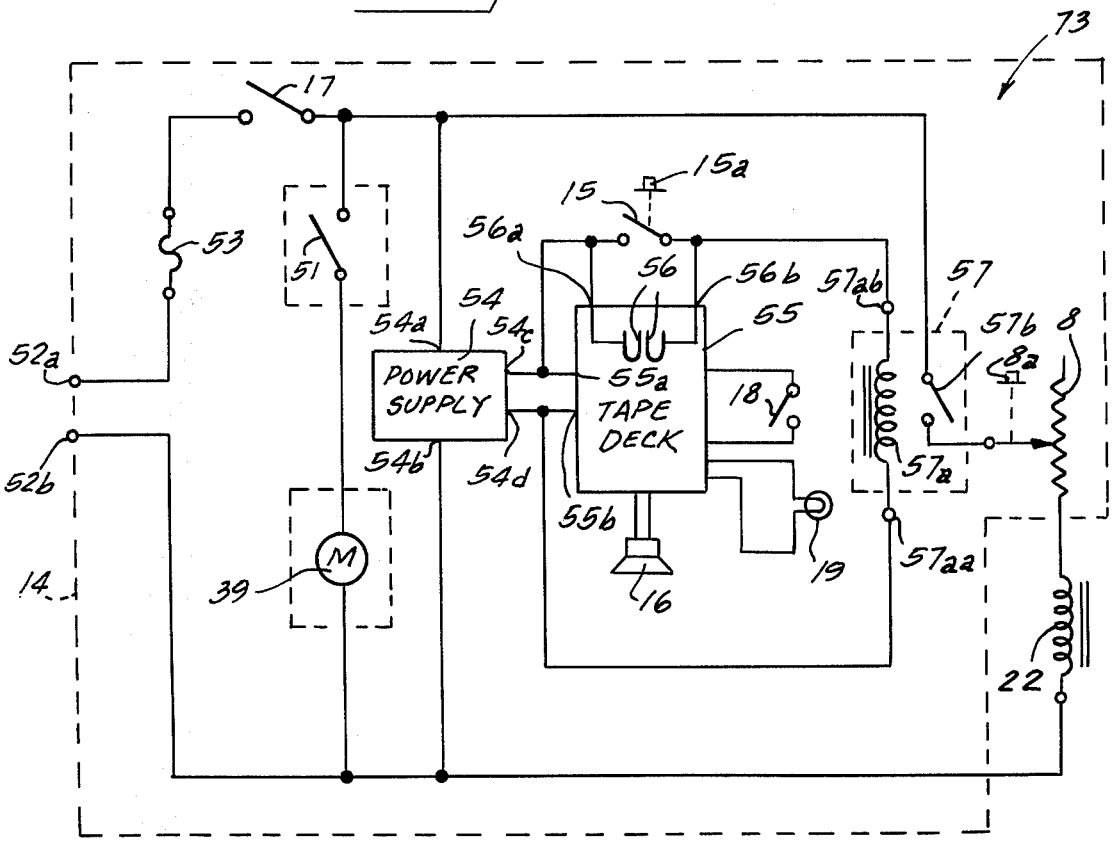
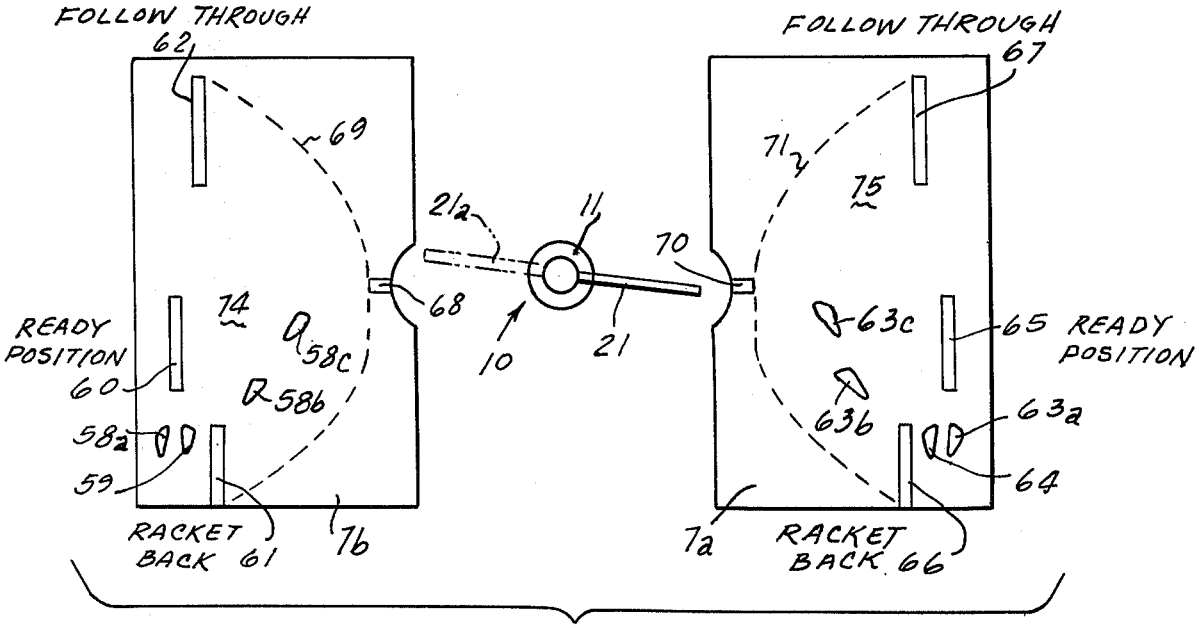
Fig. 5

TENNIS TEACHING MACHINE WITH BALL PROJECTOR

BACKGROUND OF THE INVENTION

1. Field of the Invention

This invention relates to a tennis teaching machine and in particular to a tennis teaching machine for automated instruction.

2. Prior Art

A variety of teaching machines for baseball and tennis have been proposed. Devices which hurl tennis balls or baseballs are known. These devices either hurl the ball by spring loaded arm members or propel the ball through guides by spring or pneumatic action. In U.S. Pat. No. 3,612,027 a device for upwardly projecting a ball by means of a spring loaded ball launcher is illustrated. The launching device is remotely controlled by means of a foot pad. In U.S. Pat. No. 3,677,544 a baseball batting practice device is disclosed in which baseballs are stored within a plurality of tubes. A rotating cylinder transfers baseballs from the storage tubes and drops them over a hitting area to a ball player. In U.S. Pat. No. 3,231,271 an apparatus for teaching tennis strokes is disclosed. A ball support structure having a series of simulated tennis balls is placed adjacent a tennis player. A stringless tennis racket having a cutout portion is stroked through the simulated balls. A foot mat is placed adjacent the ball support structure to teach proper foot placement during the tennis stroke.

SUMMARY OF THE INVENTION

An object of this invention is to provide a tennis teaching machine which combines recorded instructions on a tapedeck with an automatic tennis ball projection device.

Another object of this invention is to utilize an automatic ball projection device having a ball hopper which has a rotating ball tray.

It is a further object of this invention to provide training mats having various types of tennis technique training indicia inscribed thereon. The training mat is used in combination with a tapedeck and automatic tennis ball projection device.

A tennis teaching machine of this invention utilizes training mats having tennis technique learning indicia inscribed thereon. A supporting pole with a ball hopper is placed between two such mats. An extension arm having a remotely controlled ball projection means protrudes from the ball hopper. A motor driven rotary ball tray mounted within the ball hopper supplies tennis balls to the extension arm and ball projection device. A control unit having a tapedeck activates the ball projection means. Tennis technique instructions are recorded on magnetic tape played by the tapedeck. Metal foil strips placed on the tape are detected by a sensing means and automatically activate the ball projection means in coordination with the tennis instructions.

Other objects, features, and advantages of the invention will be apparent in the following detailed description of the illustrative embodiments of this invention.

BRIEF DESCRIPTION OF THE DRAWINGS

FIG. 5 is a plan view of the tennis technique training mats used in combination with the tennis teaching machine of FIG. 1; and FIG. 6 is a schematic diagram of the electronic control circuitry of this invention.

DESCRIPTION OF THE PREFERRED EMBODIMENTS

Figure 1:
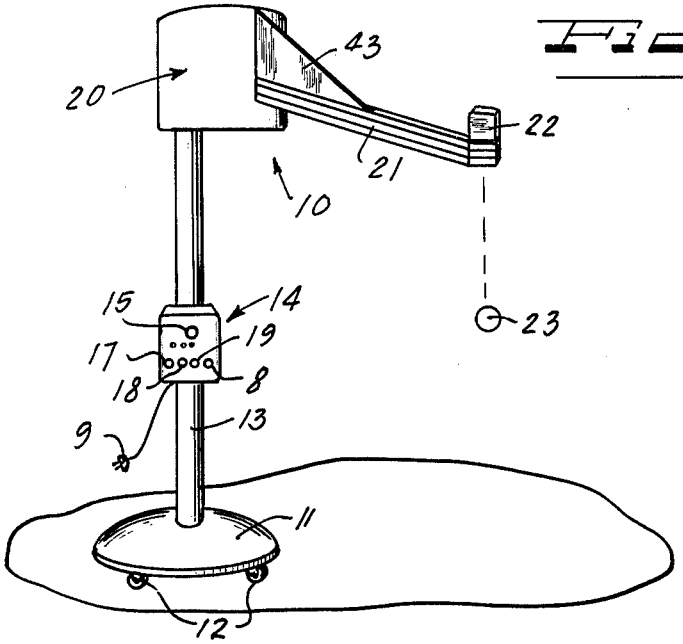
FIG. 1 is a perspective view of a tennis teaching machine of this invention.

As shown in FIGS. 1 and 5, a tennis teaching machine 10 is positioned between the training mats 7*a* and 7*b*. A base 11 of the tennis teaching machine 10 has casters 12. A vertical support 13 is mounted at right angles to the base 11. A control unit 14 is secured to an intermediate portion of the vertical support 13. A ball drop switch 15, power switch 17, lesson start switch 18, start indicator light 19, and ball bounce control 8 are mounted on a front panel of the control unit 14. Power cable 9 extends from the bottom portion of the control unit 14 and can be connected to a suitable power supply. A ball hopper member 20 is slidably mounted on the top end of the vertical support 13. A hollow extension arm 21 protrudes from the hopper 20 and is supported by brace 43. A ball projecting solenoid 22 is fastened to a horizontal end portion of the hollow extension arm 21. A tennis ball 23 can be projected downwardly from the end of the extension arm 21 by action of the solenoid 22.

Figure 2:
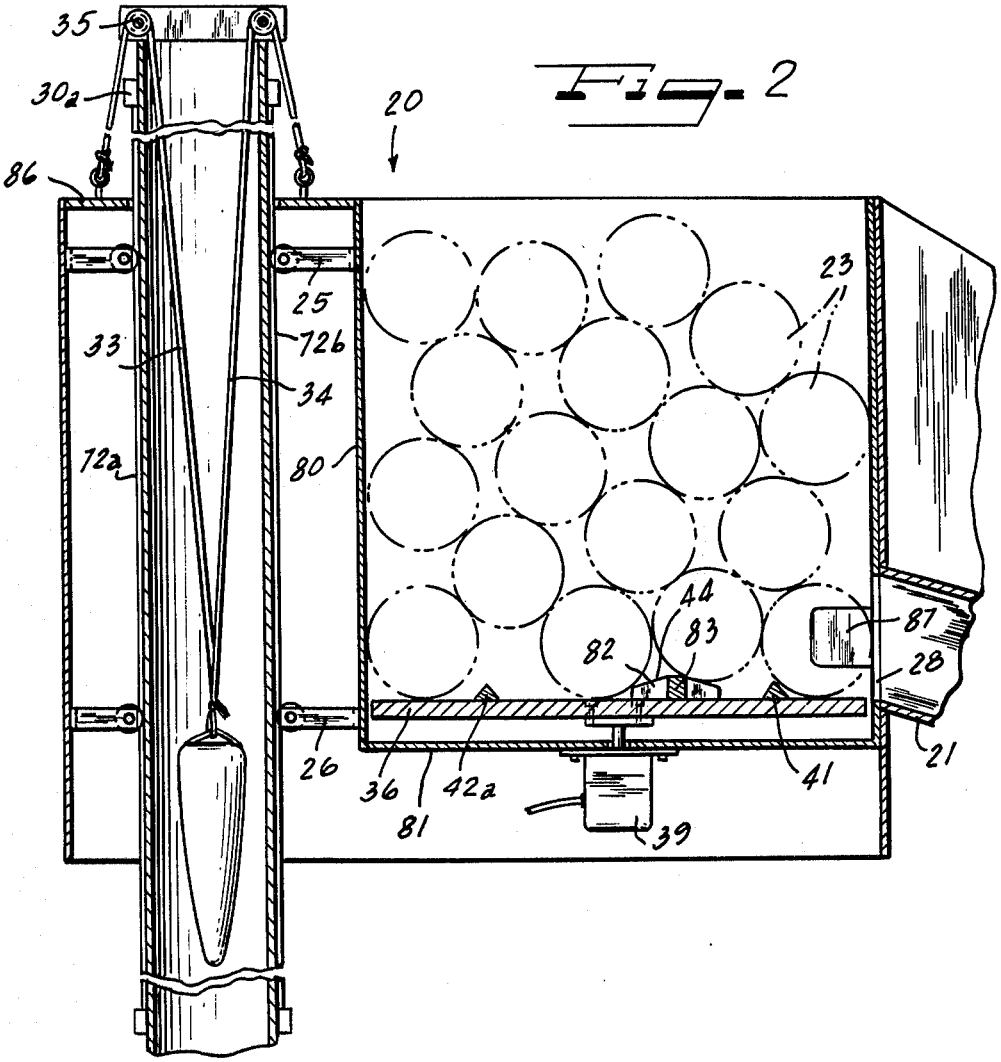
FIG. 2 is a vertical cross-sectional view of a tennis ball hopper of this invention.
Figure 3:
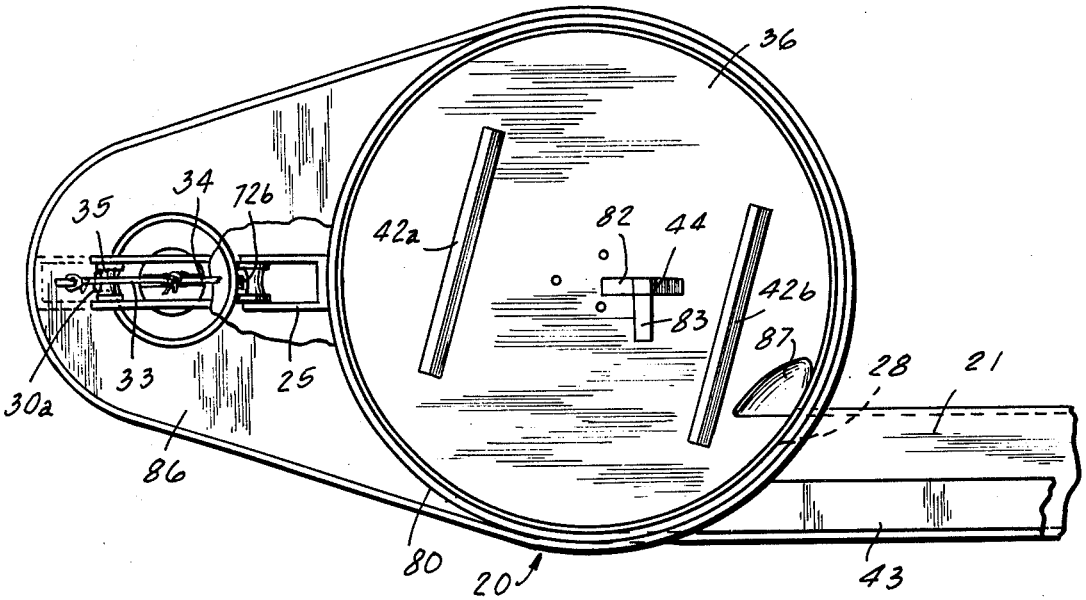
FIG. 3 is a sectional view taken along lines III—III of FIG. 2 illustrating detail of a rotary ball tray of this invention.
Figure 4:
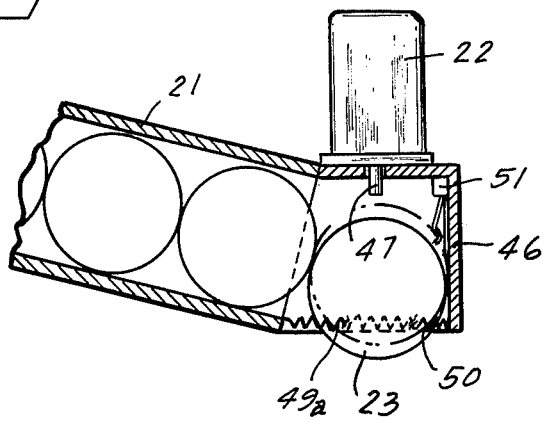
FIG. 4 is a vertical cross-sectional view of an extension arm and ball projection mechanism of this invention.

Additional features of the ball hopper 20 are most clearly shown in FIGS. 2, 3, and 4. The ball hopper 20 has a ball container 80 into which the tennis balls 23 are received. An opening 28 is formed in container 80 and permits tennis balls 23 to enter and pass down arm 21. A vertical raised guide channel 72 is provided on the periphery of the vertical support 13. Stops 30*a* and 30*b* are positioned at the upper and lower ends of the raised guide channel 72. The inner wall of frame members 25 and 26 which support the hopper 80 engage the raised guide channel 72 and prevent the ball hopper 80 from rotating relative to support 13.

One end of a cable 33 is attached by a suitable clamp 34 to the upper cover 86 of the frame members of the hopper 20. A counterweight 32 is attached to the other end of the cable 33. A pulley 35 is mounted at the top end of the vertical support 13 and cable 33 passes over the pulley 35 and permits selective vertical positioning of the ball hopper 80 relative to the vertical support 13 for loading or operating. A second cable 34 is connected to bias the other side of the hopper 80.

A ball delivery disc 36 is rotatably supported near the bottom of hopper 80 and is driven by motor 39 mounted on the bottom 81 of hopper 80.

As shown in FIG. 3, a pair of raised ribs 42*2* and 42*b* are attached to the top surface of the ball disc 36 as shown. A ball delivery member 44 has two portions 82 and 83 attached to disc 36 as shown. Extension arm 21 is tangentially secured to the ball hopper 80 as shown in FIG. 3 and an opening 45 in arm 21 adjacent supporting wall 26 permits the entry of balls 23 into the extension arm 21. A block 87 is mounted on the side wall of container 80 adjacent the opening 45 to engage the balls 23 so they will enter the opening.

As shown in FIG. 4, the extension arm 21 slopes downwardly and is supported by brace 43. End portion 46 is formed horizontally to facilitate vertical projection of a tennis ball 23. The solenoid 22 is mounted on an upper surface of the end portion 46. A solenoid push rod 47 projects a tennis ball 48 through ball release springs 49*a*, *b* when the solenoid is energized. An aperture 50 is provided in the end portion 46 to allow the tennis balls 48 to move downwardly to engage the floor. A momentary contact ball position switch 51 is mounted on an inner surface at the end of the extension arm 21 to be engaged by a tennis ball 23. Brace 43 can be removed to allow arm 21 to fold down for transport.

The control circuitry 73 of the invention is illustrated in FIG. 6 and has AC power source input terminals 52*a* and 52*b*. A fuse 53 connects power source terminal 52*a* to a power switch 17. The momentary contact ball position switch 51 and ball tray driving motor 39 are connected in series between the open side of power switch 17 and power input terminal 52*b*. Input terminals 54*a* and 54*b* of power supply 54, respectively, connect to the open side of power switch 17 and power input terminal 52*b*. Power supply output terminal 54*c* connects to one side of a manual ball drop switch 15. Terminal 56*a* of a tape foil sensor 56 connects to the one side of switch 15. Power terminal 55*a* of tape deck 55 connects to terminal 54*c*. Output terminal 54*d* of power supply 54 connects to terminal 57*aa* of one end of relay coil 57*a*. Terminal 57*aa* connects to power input terminal 55*b* of tape deck 55. Speaker 16 connects to tape deck 55. A tape foil sensor 56 is mounted on the tape deck 55. Terminals 56*a* and 56*b* of sensor 56 connect to opposite sides of the manual ball drop switch 15. Switch 15 may be closed by button 15*a* for manual operation of the invention. A lesson switch 18 is connected to the tape deck 55 for activating the tapedeck in the play-back mode. The start-lesson indicator light 19 connects to the tapedeck 55 and is illuminated when the tape is at the beginning of the play mode. The second terminal 57*ab* of relay coil 57*a* connects to the tape foil sensor 56*b* and to the second side of ball drop switch 15. Relay contacts 57*b*, a ball bounce control potentiometer 8, and the solenoid 22 are connected in series between the normally open side of power switch 17 and power source input terminal 52*b*. A control knob 8*a* controls the setting of ball bounce control potentiometer 8 to allow the force of the ball hitting push rod 47 to be varied.

The portion of the control circuitry enclosed within dotted lines may be mounted within the control unit 14. The solenoid 22, ball position switch 51, speaker 16, and motor 39 may be external components.

The training mats 7*a* and 7*b* shown in FIG. 7 have various tennis technique learning indicia. The base 11 and extension arm 21 of the tennis teaching machine 10 are illustrated between the training mats 7*a* and 7*b*. A rotated position 21*a* of the extension arm 21 is also shown. Area 74 of the training mat 7*b* has training indicia for right-handed players learning forehand techniques and for left-handed players learning backhand techniques. Foot position indicia 58*a* and 59 illustrate the proper position of the feet having the ready position. Foot indicia 59 and 58*c* illustrate the proper foot position for a right-handed forehand shot at a point of impact. Foot indicia 59 and 58*b* illustrate the proper foot position for a left-handed backhand shot, at point of impact. Racket position indicia 60 (ready position), 61 (racket back), 68 (sweet spot), and 62 (follow through) illustrate to the student the proper racket positions for both forehand and backhand shots. In similar manner, an area 75 on training mat 7*a* has foot and racket position indicia for use in teaching a right-hander the backhand shot and a left-hander the forehand shot. Foot position indicia 63*a* and 64 illustrate the position of the feet during the ready position. Foot indicia 64 and 63*b* illustrate the proper foot position at point of impact for a right-handed backhand shot. Foot indicia 64 and 63*c* illustrate the proper foot position at point of impact for a lefthanded forehand shot. Indicia 65, 66, 67, and 70 illustrate the position of the racket. Curved lines 69 and 71 illustrate the trajectory for the tennis racket when it is swung properly.

The tennis teaching machine 10 and mat 7*b* are used by a student by placing his feet on the foot indicia 58*a* and 59*a*. The tennis racket is aligned with the ready-position mark 60. The hopper is lowered and tennis balls are placed in the ball hopper 20 and pass into the extension arm 21. The hopper is moved to the railed position. The student or an instructor activates the teaching machine 10 by closing power switch 17. The lesson-start switch 18 is closed which illuminates start-indicator light 19. The lesson tape containing recorded instructions are played by tapedeck 55 and the audio output appears at loudspeaker 16. The student may be instructed to properly grip the racket and then to position his feet and racket over the indicia on the training mat 7. The student is told how to swing the racket and is told when a ball will be projected onto the mat for his swing. When the time arrives for the student to swing, a segment of metal foil tape previously placed on the lesson tape will pass and be detected by tape foil sensor 56. This will complete the circuit to relay coil 57*a* which is energized and closes relay contacts 57*b*. This actuates solenoid 22 and the solenoid push rod 47 is moved to project tennis ball 48 through springs 49*a*,*b* in a downward trajectory. The ball hits the mat and bounces and the student swings through to hit the ball. The height of the ball bounce is controllable by the amount of current flowing through solenoid 22 which can be selected by the ball bounce control 8. When the tennis ball 48 is released, other balls stored in the extension arm 21 roll downwardly toward the lower end of arm 21 to momentarily close the contacts of ball position switch 51 this actuates motor 39 which rotates ball tray 36 to supply an additional ball into the upper end of extension arm 21. A manual ball projection switch 15 is also provided to allow the instructor to manually energize the ball projector. If an instructor desires to override the taped instructions, he presses button 15*a* to manually activate the ball projection solenoid 22.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention, as defined in the appended claims.

We claim as our invention:

1. A tennis teaching machine adapted for projecting tennis balls in response to an automatic control comprising:

a supporting means;

an extension arm connected so said supporting means;

ball projection means remote from said supporting means on said extension arm;

control means connected to said ball projection means, said control means having a tapedeck for automatic activation of said ball projection means in coordination with recorded tennis technique instructions in which said ball projection means comprises a solenoid for projecting the tennis balls.

2. The machine of claim 1 in which said supporting means comprises a pole on which said ball hopper is slidably engaged.

3. The machine of claim 1 in which said ball projection means includes springs for ball retension.

4. The machine of claim 1 in which said tapedeck has a metal foil sensing means mounted thereon for activating said ball projection means at a predetermined time.

5. The machine of claim 4 in which a manual control connects across said metal foil sensing means for manually activating said ball projection means.

6. A tennis teaching machine system adapted for automatically bouncing tennis balls within a predefined area on a training mat comprising:

a. a training mat having tennis technique learning indicia inscribed thereon;

b. a supporting pole;

c. a ball hopper slidably mounted on said supporting pole;

d. an extension arm connected to said ball hopper;

e. a ball projection means remote from said ball hopper on said extension arm;

f. a motor driven rotary ball tray mounted in said ball hopper to supply balls to said extension arm and ball projection means; and g. a control unit electrically connected to said ball projection means, said control unit having a tapedeck with metal foil sensing means for automatically activating said ball projection means in coordination with recorded tennis technique instructions.

7. A tennis teaching machine adapted for projecting tennis balls in response to an automatic control, comprising:

a supporting means;

an extension arm connected to said supporting means;

ball projection means remote from said supporting means on said extension arm;

control means connected to said ball projection means, said control means having a tapedeck for automatic activation of said ball projection means in coordination with recorded tennis technique instructions wherein a ball hopper connects with said supporting means and said extension arm and wherein said ball hopper has a motor driven rotary ball tray supported therein and a ball position switch on said extension arm for activating said motor driven rotary ball tray.

* * * * *

UNITED STATES PATENT AND TRADEMARK OFFICE

CERTIFICATE OF CORRECTION

PATENT NO. : 4,021,036
DATED : May 3, 1977
INVENTOR(S) : David M. Nelson et al

It is certified that error appears in the above-identified patent and that said Letters Patent are hereby corrected as shown below:

Column 2, line 59, "422" should be --42a--.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*